US005754925A

United States Patent [19]

Yui et al.

[11] Patent Number: 5,754,925

[45] Date of Patent: May 19, 1998

[54] IMAGING FORMING APPARATUS WITH ENHANCED CLEANING OF RESIDUAL MATTER USING A DEVELOPING/ CLEANING DEVICE

[75] Inventors: Yuhi Yui, Nabari; Katsumi Adachi, Ikoma-gun; Takashi Hayakawa, Soraku-gun; Eiichi Kido, Yamatokoriyama; Koichi Moriyama, Ikoma; Toyokazu Mori, Yamatokoriyama, all of Japan

[73] Assignee: Sharp Kabushiki Kaisha, Osaka, Japan

[21] Appl. No.: 721,442

[22] Filed: Sep. 27, 1996

[30] Foreign Application Priority Data

Nov. 1, 1995 [JP] Japan ..... 7-285056

[51] Int. Cl.[6] ..... G03G 15/24

[52] U.S. Cl. ..... 399/150

[58] Field of Search ..... 399/149, 150, 399/129, 174–176, 100

[56] References Cited

U.S. PATENT DOCUMENTS

| | | |
|---|---|---|
| 4,769,676 | 9/1988 | Mukai et al. . |
| 5,196,891 | 3/1993 | Shimazaki et al. . |
| 5,196,892 | 3/1993 | Mitsuaki . |
| 5,436,700 | 7/1995 | Kikuchi et al. . |
| 5,497,224 | 3/1996 | Ishikawa et al. . |
| 5,517,289 | 5/1996 | Ito et al. . |
| 5,541,717 | 7/1996 | Saito et al. . |

FOREIGN PATENT DOCUMENTS

| | | |
|---|---|---|
| 62-203182 | 9/1987 | Japan . |
| 4-20986 | 1/1992 | Japan . |
| 5-346726 | 12/1993 | Japan . |

*Primary Examiner*—Robert Beatty

*Attorney, Agent, or Firm*—David G. Conlin; George W. Neuner

[57] ABSTRACT

An image forming apparatus includes: an image support medium; a charging member for charging the surface of the image support medium in contact with the surface of it; an exposure device for irradiating with light the surface of the image support medium charged by the charging member to form a static latent image; a developing device for supplying developer to the static latent image formed on the image support medium to develop the latent image and for removing the leftover developer on the image support medium; a transfer device for transferring the developer image, which has been developed on the image support medium by the developing device, to a member to be transferred; and a scraping member for scraping foreign matter such as dust and paper particles on the image support medium. The image forming apparatus is constructed such that the charging member causes the developer to adhere to the scraped foreign matter, and then the foreign matter is collected by the developing device through the image support medium. The scraping member is held by a holder which has an opening for allowing the foreign matter to pass through into the charging member housing.

4 Claims, 7 Drawing Sheets

IMAGING FORMING APPARATUS WITH ENHANCED CLEANING OF RESIDUAL MATTER USING A DEVELOPING/ CLEANING DEVICE

BACKGROUND OF THE INVENTION (1) Field of the Invention

The present invention relates to an image forming apparatus such as an electrophotographic copier, an electrophotographic printer and an electrophotographic facsimile which makes use of an electrophotographic process.

(2) Description of the Prior Art

Conventionally, in the image forming apparatus using an electrophotographic technique, a static latent image formed on an image support medium is developed with developer, and the developed image is transferred to a member to be transferred by a transfer means. Then, the untransferred developer which remains on the image support medium is scraped from the image support medium using a cleaning blade etc. and then is collected in a waste toner box.

A prior method of eliminating a cleaning unit (as referred to "non-cleaning process") can be found in Japanese Patent Application Laid-Open Sho 62-203182 and Japanese Patent Application Laid-Open Hei 4-20986. In these methods, in stead of scraping off the leftover toner after the transfer, the leftover toner image is dispersed, and after another latent image is formed by conducting the charging and exposing processes, the dispersed toner is cleaned away while this latent image is developed.

The conventional scraping method which uses the cleaning blade has the following problems:

(1) To reliably scrape the leftover toner or any other foreign matter by a blade, it is difficult to control the pressure of the cleaning blade to be exerted on the photoreceptor. That is, if the exerted pressure is too strong, the photoreceptor may become damaged or its life may become shortened, whereas if the pressure is too weak, the leftover toner and foreign matter etc. will not be completely removed, so that a clear image cannot be obtained.

(2) More parts and/or space are needed to collect and store the scraped toner and foreign matter, and it is difficult to make the apparatus compact thus resulting in an increase in cost.

(3) It is necessary to detect the condition of collected waste toner and inform the operator of the detected information. This also makes it difficult to keep the apparatus compact thus resulting in an increase in cost. In addition, if the condition of collected waste toner is not detected, there is a concern that the waste toner might overflow inside the apparatus thus polluting the apparatus.

(4) When the waste toner becomes full, the user needs to replace the waste toner box. This may cause the user's body or clothes to become soiled.

The conventional non-cleaning process has a problem. That is, there is no method provided to remove the foreign matter such as dust which adheres to the photoreceptor, so that a clear image cannot be obtained.

SUMMARY OF THE INVENTION

It is therefore an object of this invention to provide an image forming apparatus which removes the foreign matter such as dust adhering to the image support medium in the non-cleaning process in order to obtain clear images.

In accordance with an aspect of the present invention, there is provided an image forming apparatus which comprises: an image support medium; a charging member for charging the surface of the image support medium in contact with the surface thereof; an exposure means for irradiating with light the surface of the image support medium charged by the charging member to form a static latent image; a developing means for supplying developer to the static latent image formed on the image support medium to develop the latent image and for removing the leftover developer on the image support medium; a transfer means for transferring the developer image, which has been developed on the image support medium by the developing means, to a member to be transferred; and a scraping member for scraping foreign matter on the image support medium, wherein the charging member causes the developer to adhere to the foreign matter scraped by the scraping member and places the foreign matter onto the image support medium, and the foreign matter conveyed by the image support medium is collected from the image support medium by the developing means.

In this way, the foreign matter adhering to the image support medium can be securely collected by the developing means, thus always making it possible to obtain clear images.

The scraping member comprises an elastic member which abuts on the image support medium and a holding member for holding the elastic member. Therefore, it becomes possible to maintain the appropriate strength of pressure against the image support medium, and the foreign matter adhering to the image support medium can be securely collected by the developing means, thus enabling a clear image to always be obtained.

Further, the holding member has an opening to allow the foreign matter to pass therethrough.

In this way, the developer and foreign matter scraped from the image support medium can be reliably conveyed to the charging member side. Thus, by means of charging the conveyed developer and foreign matter and causing the developer to adhere around the foreign matter, it becomes easier to attract the foreign matter to the image support medium, and the foreign matter can be reliably collected, so that a clear image can always be obtained.

The image forming apparatus further comprises a scraper, which is disposed around the periphery of the charging member, for collecting the foreign matter scraped by the scraping member.

As a result, it is possible to securely capture foreign matter which cannot be charged by the charging member. Therefore, the foreign matter can be reliably collected, thereby making it possible to always obtain a clear image.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENTS

An image forming apparatus in accordance with an embodiment of the present invention will be described with reference to FIGS. 1 through 5. Here, the description relates only to the case where the image forming apparatus of the present invention is applied to a laser printer.

Figure 2:
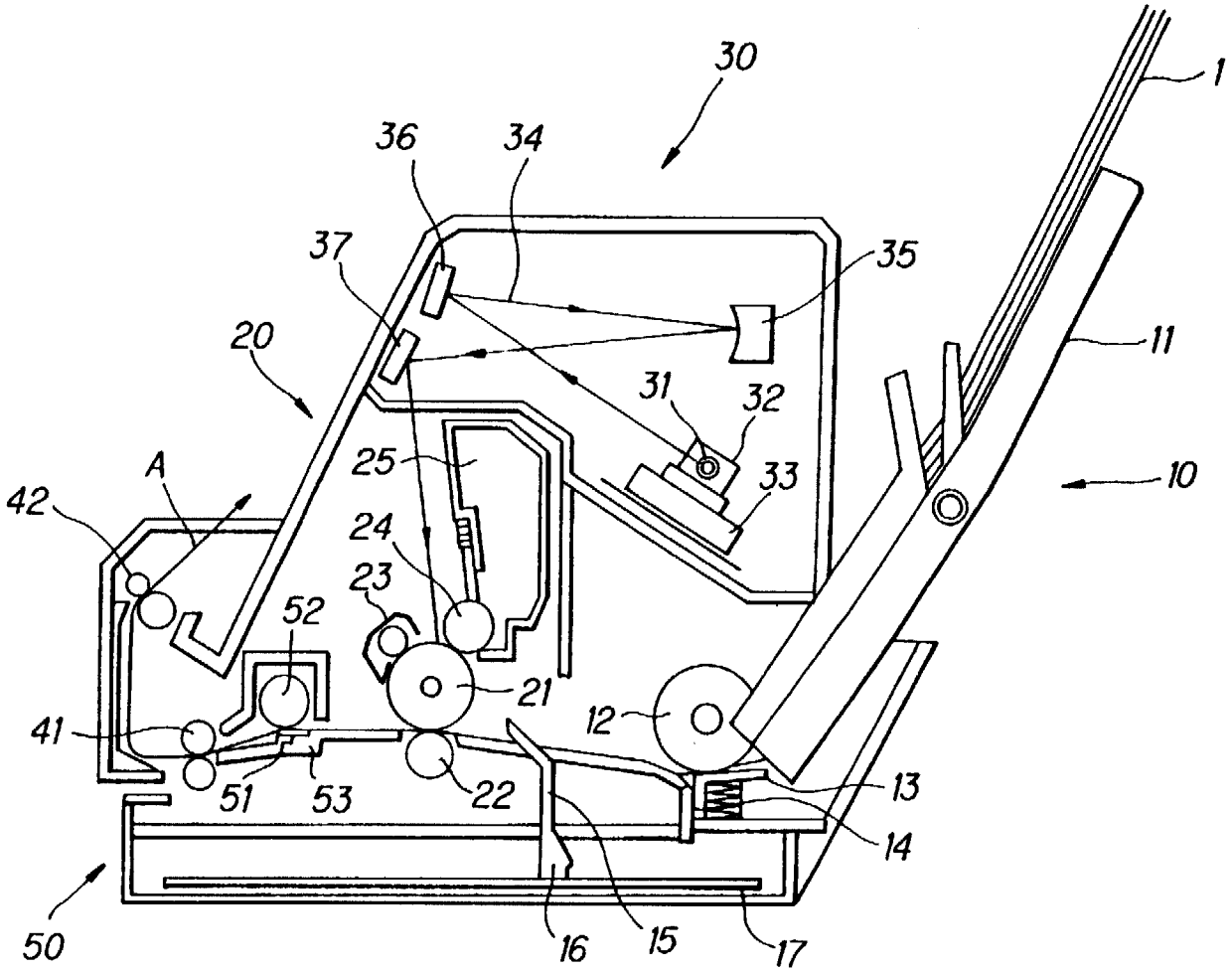
FIG. 2 is an overall view showing a laser beam printer using the image forming apparatus of the invention.

As shown in FIG. 2, the laser printer includes: a sheet feeder 10; a fixing unit 50; a laser scanner 30; and an image forming apparatus 20 of the invention. The sheet feeder 10 conveys a sheet 1 to the image forming apparatus 20 inside the printer, and the image forming apparatus 20 transfers a toner image to the conveyed sheet 1. The sheet 1 is further conveyed and the toner is fixed on it in the fixing unit 50.

The sheet is then discharged from the printer by sheet conveying rollers 41 and 42. That is, the sheet 1 travels along a path indicated by the bold line in the direction of an arrow A in the figure.

The sheet feeder 10 includes: a sheet feeding tray 11; a feed roller 12; a frictional sheet separating plate 13; a pressure spring 14; a sheet detecting actuator 15; a sheet detection optical sensor 16; and a control circuit 17.

In response to the printing order from an unillustrated host computer which is connected outside the machine, the sheets 1 located in the sheet feeding tray 11 are supplied one by one inside the printer by the functions of the feed roller 12, the frictional sheet separating plate 13 and the pressure spring 14.

The sheet detecting actuator 15 is pushed down as the sheet 1 passes over it and then the sheet detection optical sensor 16 generates an electric signal to send out the instructions to start the image printing operation. The control circuit 17, which is actuated by the sheet detecting actuator 15, sends the image signals to a laser-diode light emitting unit 31 in the laser scanner 30 so as to control the activation of the light emitting diode.

The laser scanner 30 includes: the laser-diode light emitting unit 31; a scanning mirror 32; a scanning mirror motor 33; and reflection mirrors 35, 36 and 37.

The scanning mirror 32 is rotated at a high and uniform speed by the scanning mirror motor 33. Accordingly, a laser beam 34 scans in the direction perpendicular to the document face of FIG. 2. The laser beam 34 emitted from the laser-diode light emitting unit 31 is irradiated onto a photoreceptor 21, which will be described later, via the reflecting mirrors 35, 36 and 37. In this situation, the photoreceptor 21 is selectively exposed by the laser beam 34 based on the information about the activation of the light emitted from the control circuit 17.

The image forming apparatus 20 includes: the photoreceptor 21; a transfer roller 22; a charging unit 23; a developing roller 24; and a developing unit 25.

The surface of the photoreceptor 21 which has been already charged at a predetermined potential level by the charging unit 23 is exposed to the laser beam 34, so that the surface potential of the photoreceptor 21 is selectively discharged to produce a static latent image. The toner to be used for development is stored in the developing unit 25.

In the developing unit 25, the toner is appropriately agitated in order to be charged. Then, the thus charged toner adheres to the surface of the developing roller 24. In this way, the toner image corresponding to the static latent image is formed on the photoreceptor 21 by the action of a developing bias voltage supplied to the developing roller 24 and an electric field which has been created on the surface potential of the photoreceptor 21.

The sheet 1 conveyed from the sheet feeder 10 is fed between the photoreceptor 21 and the transfer roller 22. The toner on the photoreceptor 21 is electrically attracted and transferred onto the sheet 1 by the action of the electric field created by the transfer voltage applied to the transfer roller 22. After the toner on photoreceptor 21 is transferred to the sheet 1 by the transfer roller 22, the remaining toner image on the photoreceptor 21 after the transfer is dispersed, and another static latent image is formed by repeating the process of charging and exposing. As soon as the thus formed static latent image is developed, the leftover toner is collected in the developing unit.

Then, the sheet 1 is conveyed to the fixing unit 50 where it is heated and pressurized between a pressuring member 51 and a fixing roller 52 which is maintained at a temperature of 170° C. The toner is then fused on the sheet 1 and fixed onto it to make a solid image. Here, designated at 53 is a guiding member for guiding the sheet 1 to the fixing unit. The sheet 1 is then conveyed by the sheet conveying rollers 41 and 42 and discharged from the machine. The charging unit 23 used in the image forming apparatus 20 will be detailed hereinafter.

Figure 1:
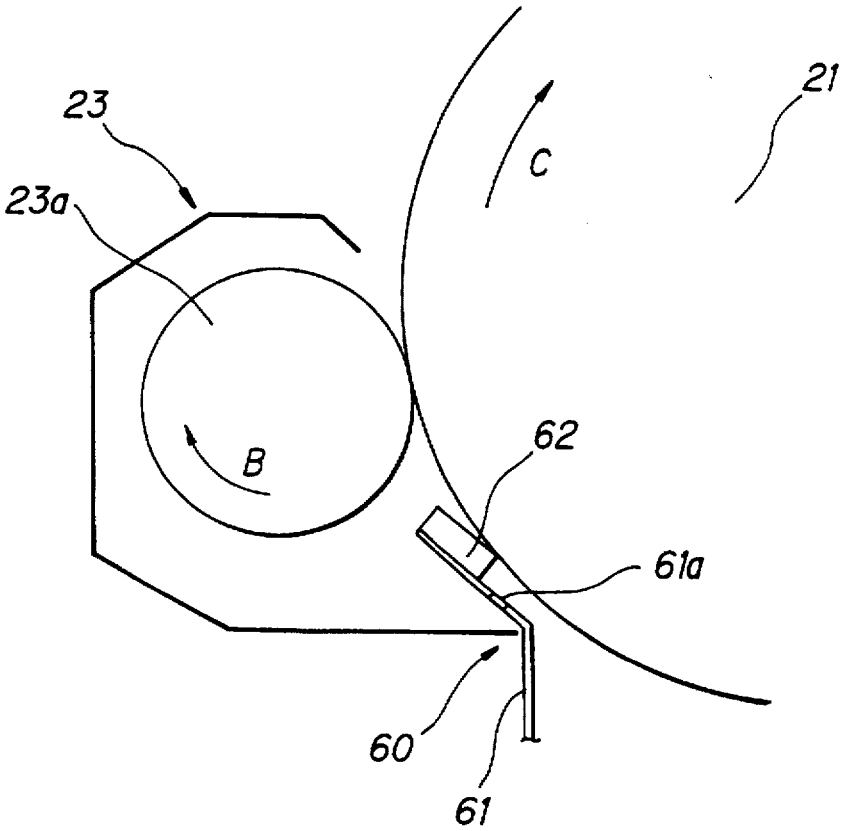
FIG. 1 is a partial side view showing an embodiment of an image forming apparatus of the invention.
Figure 4:
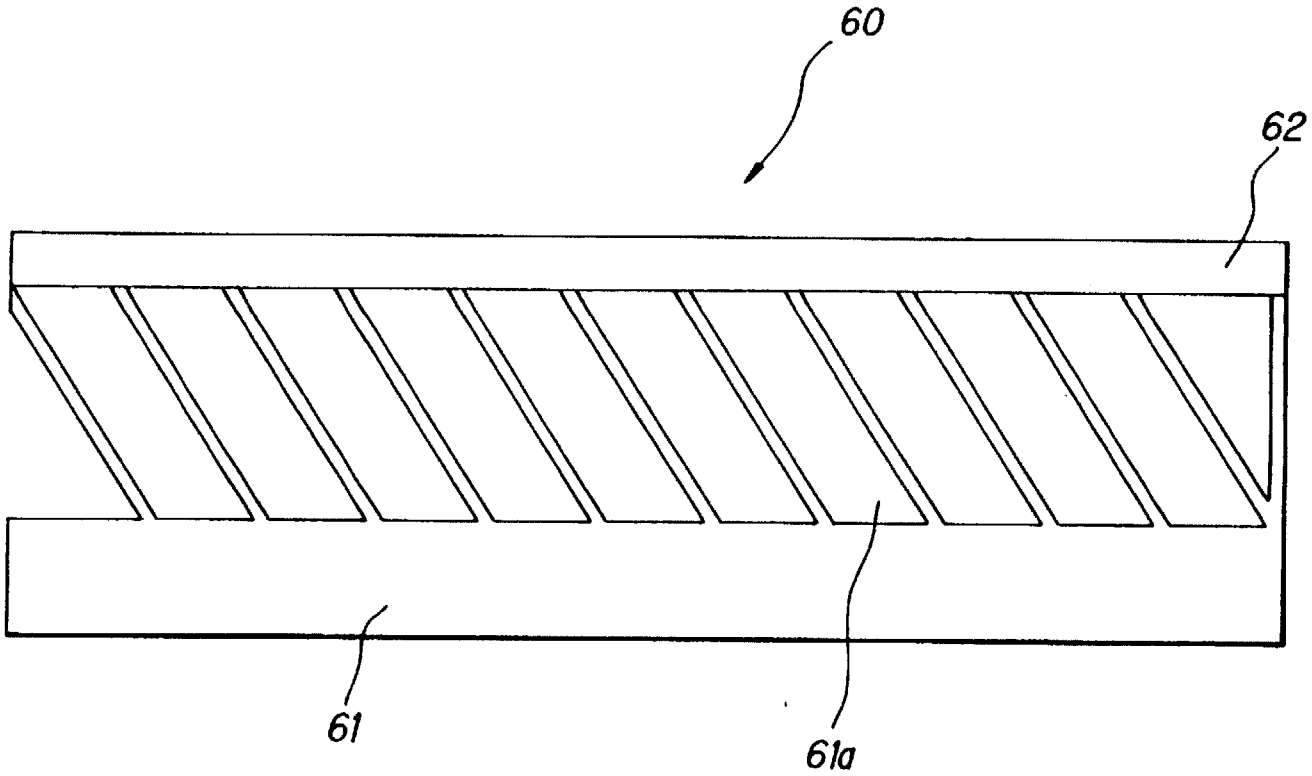
FIG. 4 is a front view showing the scraping member shown in FIG. 1.

As shown in FIG. 1, the charging unit 23 is located opposite the photoreceptor 21, and the charging unit 23 includes a charging roller **23*a* and a scraping member 60 which is made up of an elastic blade 62 for scraping foreign matter and a holding member 61 (which has holes 61*a*) to hold the blade 62** (see FIG. 4).

In this embodiment, the blade 62 is made from urethane having the Ascor C hardness of 60 to 70 degrees. The holding member 61 uses SUS304CSP-H of 50 μm and elastically presses the blade 62 against the photoreceptor with a pressure of 5 to 10 g/cm$^2$.

In the image forming using the electrophotographic printing process, some bias is always applied to the surface of the photoreceptor 21 to form a static latent image and toner image on the surface of the photoreceptor 21. Therefore, foreign matter such as dust and paper particles, etc. is attracted by static force from the surface of photoreceptor 21.

In the prior method using a cleaning blade, no problems occurred because foreign matter is scraped from the photoreceptor surface by an elastic member such as rubber and urethane. However, in the non-cleaning process which has recently become more diversified, it is impossible to remove foreign matter when it has once adhered to the photoreceptor surface. This gives rise to problems such as image missing (reversal development) and dark spots (normal development) due to the foreign matter.

The purpose of this invention is to solve the above problems. As shown in FIG. 1, the foreign matter and the leftover toner adhered to photoreceptor 21 are continuously scraped by the blade 62 of the scraping member 60 with the rotation of photoreceptor 21 (in the direction of arrow C). The thus scraped foreign matter and leftover toner pass through the holes **61*a* provided in the holding member 61 and are then charged whilst being agitated by the rotation of the charging roller 23*a*** (in the direction of arrow B), so that a number of toner particles adsorb the surface of the foreign matter.

The foreign matter to which the leftover toner has adhered is conveyed downstream by the rotation of the charging roller 23*a*. Then, the foreign matter is accumulated on the photoreceptor 21 because the leftover toner which has adhered to the foreign matter is attracted onto the charged surface of the photoreceptor 21. The leftover toner and the foreign matter to which the leftover toner adheres are conveyed by the rotation of the photoreceptor 21 to the developing unit 25 and are collected therein.

The holding member 61 of the scraping member 60 has the inclined holes 61*a* (see FIG. 4) to allow foreign matter to pass through. Therefore, foreign matter can pass through the holes without being obstructed by ribs defining the holes. Accordingly, the toner and foreign matter which have been scraped from the photoreceptor 21 are securely conveyed to the charging roller 23*a* side. The toner and foreign matter are charged so that the toner particles will adhere around the foreign matter. In this way, foreign matter can be readily attracted to the photoreceptor 21 and consequently can effectively be collected.

Figure 3:
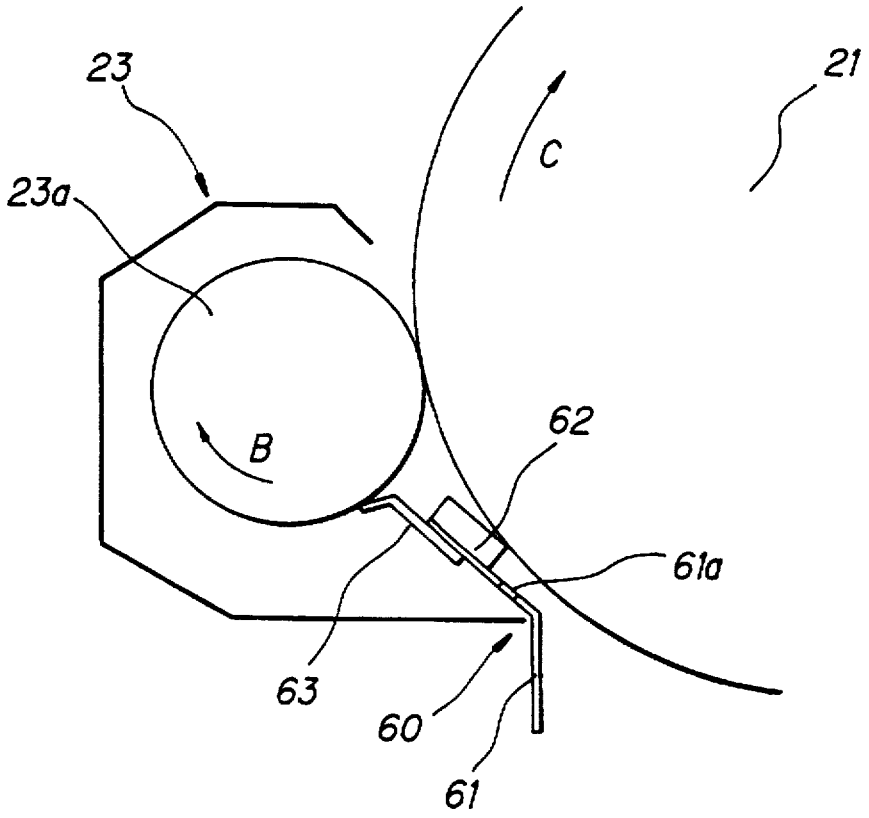
FIG. 3 is a partial side view showing a regulating member provided in the scraping member shown in FIG. 1.

As shown in FIG. 3, a regulating member 63 which comes into contact with the charging roller 23*a* is provided for the holding member 61 adjacent to the reverse side of the blade 62 so that foreign matter is conveyed toward the charging member. Therefore, the toner and foreign matter scraped by the scraping member 60 will not directly adhere to the photoreceptor 21. The toner and foreign matter are then charged at the charging roller 23*a* sufficiently to ensure that the toner will adhere around the foreign matter. This makes it easier to attract the foreign matter to the photoreceptor 21 and consequently the foreign matter can be reliably collected.

Further, the photoreceptor 21 rotates in the same direction as the charging roller 23*a* (that is, the directions are opposite at the point where they meet).

Thus, the photoreceptor 21, the toner and foreign matter can be charged more efficiently, so that the toner will adhere well around the foreign matter. This makes it easier to attract the foreign matter to the photoreceptor 21 and consequently the foreign matter can be reliably collected.

Figure 5:
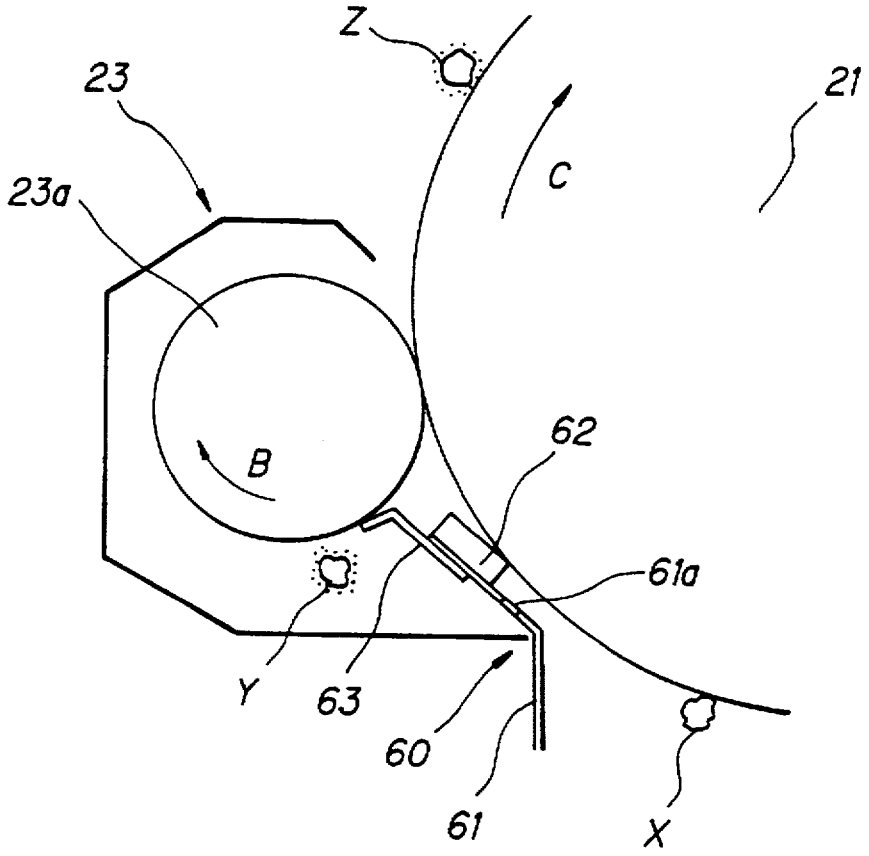
FIG. 5 is a partial side view explaining a process in which foreign matter on a photoreceptor is scraped by the scraping member and again conveyed to the photoreceptor.

FIG. 5 is an illustration showing a process (the transition state of foreign matter) in which the foreign matter on the photoreceptor 21 is scraped by the scraping member 60 and is collected in the developing unit 25. This process for collecting foreign matter in accordance with the invention will be described in detail referring to this figure.

First, the charging unit 23 having the charging roller 23*a* is disposed opposite the photoreceptor 21 as described above. This charging roller 23*a* is designed to slidably roll against the photoreceptor 21 while rotating faster than the photoreceptor 21. The conductive layer is formed on the surface of the charging roller 23*a*. Applied to the surface of the charging roller 23*a* is a voltage, from an unillustrated power source unit, which is made up of a 950 V d.c. voltage with a 350 V a.c. voltage superposed.

The surface of the photoreceptor 21 is negatively charged uniformly at about −800 V by this charging means. The image information to be recorded is irradiated by the laser beam 34 onto the charged surface of the photoreceptor 21 so as to reduce the surface potential on the photoreceptor 21 to −550 V thus forming a static latent image in the charged area.

Next, this static latent image is conveyed to a position where it faces the developing unit 25 (which has been applied with a d.c. voltage of −400 V). The toner is transferred from the developing roller 24 in the developing unit 25 to adhere to the static latent image on the photoreceptor 21. In this way, the reverse development is performed. Here, the toner is charged at −10 μc/g by friction caused by the rotation of the developing roller 24 and a voltage of −400 V which is applied to the developing roller 24.

This toner becomes the leftover toner X after the transfer, and is collected, by the scraping member 60, together with foreign matter and is charged at the charging unit 23 at the same time. In this way, toner particles adhere to the foreign matter (state Y), and then the foreign matter with the toner particles is accumulated on the charged surface of the photoreceptor 21 (state Z). Thus the foreign matter will be collected in the developing unit 25 as the photoreceptor 21 rotates.

Another embodiment of an image forming apparatus in accordance with the present invention will be described with reference to FIGS. 6 and 7. Here, for the convenience of the explanation, the same reference numerals are allotted the corresponding components to those shown in the figures in the above embodiment, thus the repeated explanation will be omitted.

Figure 6:
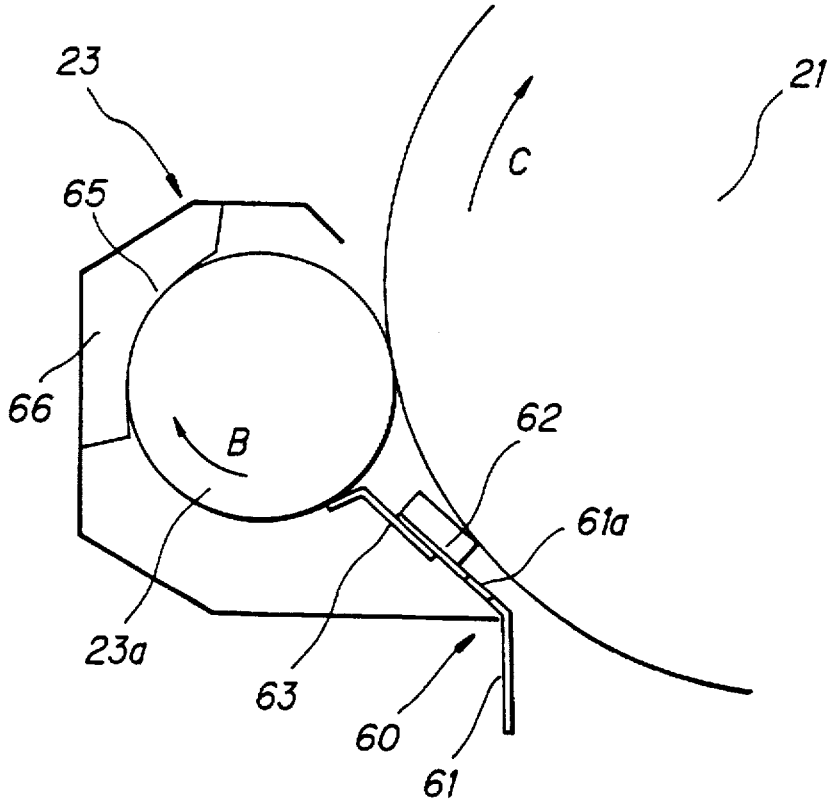
FIG. 6 is a partial side view showing a scraper provided inside the charging unit in FIG. 3.

As shown in FIG. 6, the charging unit 23 is disposed opposite the photoreceptor 21, and includes: the charging roller 23*a*; the scraping member 60, which is made up of the blade 62 for scraping foreign matter and the holding member 61 to hold the blade 62; a scraper 65 to scrape lint etc.; and a collection box 66 to collect what was scraped by the scraper 65.

In the above embodiment, some of foreign matter which have been scraped by the blade 62 may not be charged by the rotation of the charging roller 23*a*. Thus, the unchargeable foreign matter might be conveyed downstream by the rotation of the charging roller 23*a* and might adhere to photoreceptor 21.

That is, some of the foreign matter which have been scraped by the blade 62 and cannot be charged by the rotation of the charging roller 23*a* are conveyed downstream by the rotation of the charging roller 23*a*. In this embodiment, provided to capture such foreign matter is the scraper 65 which is concentrically disposed in contact with the charging roller 23*a*, between the blade 62 and the photoreceptor 21, on the upstream side with respect to the rotational direction of the charging roller 23*a*.

Figure 7:
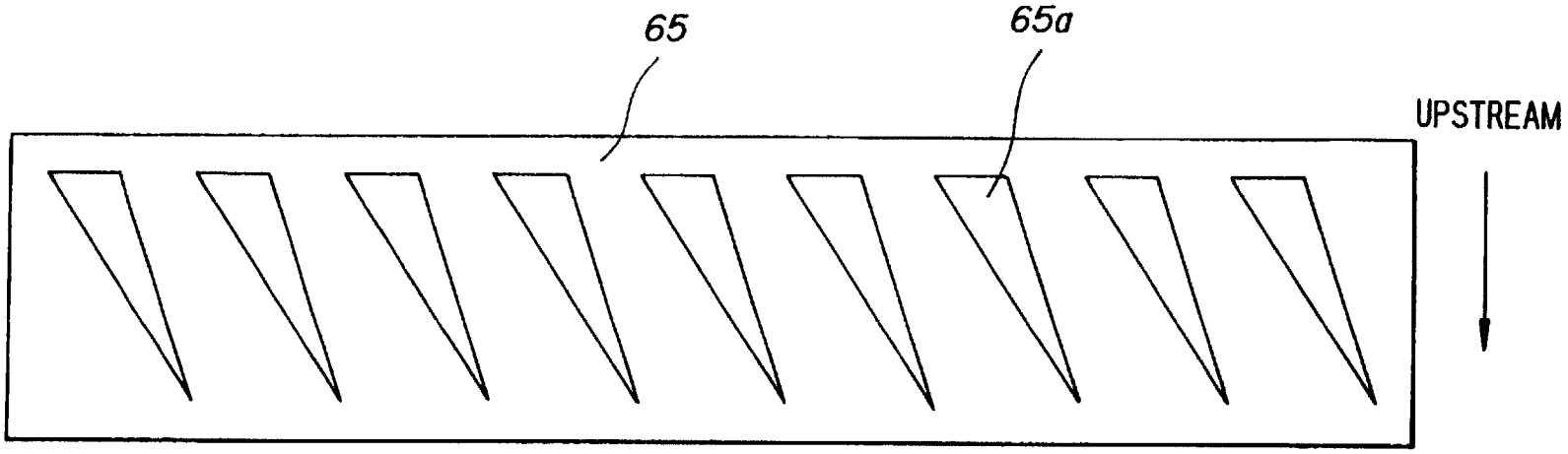
FIG. 7 is a front view showing the scraper shown in FIG. 6.

The foreign matter thus conveyed are captured by the acute-angled parts of holes 65*a*, which are preferably shaped in triangles, formed on the scraper 65 as shown in FIG. 7. The foreign matter is then collected in the collection box 66 which is arranged on the outer peripheral side of the scraper 65.

As shown in FIG. 7, the scraper 65 has the triangle shaped holes 65*a* to allow the foreign matter to pass through, so that the foreign matter captured by the scraper 65 can be effectively collected into the foreign matter collection box 66.

The scraper 65 is composed of SUS which has been processed by etching. Therefore, the scraper 65 can be manufactured with high precision free from burrs.

The scraper 65 has a thickness of 50 μm or less and is curved concentrically with the charging roller 23*a* so that it can be produced at an appropriate elasticity.

The holes 65*a* in the scraper 65 become narrower on the downstream side of the charging unit 23 so as to reliably capture foreign matter by the acute-angled parts at their front ends. Therefore, it becomes possible to collect foreign matter reliably and always obtain clear images.

In the image forming apparatus of the invention, the developing unit has a life for printing 2,000 sheets whereas the photoreceptor unit has a life for printing 20,000 sheets. Here, nothing abnormal was found in the experiment where chargeable foreign matter was collected in the developing unit. Since the amount of unchargeable foreign matter was rather small, it turned out to be possible that the collection box with only a small capacity could still collect them within its period of life.

In the above embodiment, the description is made using a charging roller as an example of a contact type charging unit. It is also possible to attain the same effects in the case where a charging brush, a non-contact type charging unit, a corotron or scorotron is used.

Here, in the case where a charging brush is used, it is preferable that the tip of the brush is made in contact with the scraper.

What is claimed is:

1. An image forming apparatus comprising:

an image support medium;

a charging member for charging the surface of said image support medium in contact with the surface thereof;

an exposure means for irradiating with light the surface of the image support medium charged by said charging member to form a static latent image;

a developing means for supplying developer to the static latent image formed on said image support medium to develop the latent image and for removing the leftover developer on the image support medium;

a transfer means for transferring the developer image, which has been developed on the image support medium by said developing means, to a member to be transferred; and a scraping member for scraping foreign matter on said image support medium, wherein said charging member causes the developer to adhere to the foreign matter scraped by said scraping member and place the foreign matter onto said image support medium, and the foreign matter conveyed by said image support medium is collected from said image support medium by said developing means;

wherein foreign matter is captured from the upstream side of the photoreceptor in a charging unit comprising the charging member and the charging member causes leftover toner to adhere around the foreign matter; and wherein the foreign matter is removed from the downstream side of the photoreceptor.

2. The image forming apparatus according to claim 1, wherein said scraping member comprises an elastic member which abuts on said image support medium and a holding member for holding said elastic member.

3. The image forming apparatus according to claim 1, further comprising a scraper, which is disposed around the periphery of said charging member, for collecting the foreign matter scraped by said scraping member, wherein said scraper has an opening to allow foreign matter to pass therethrough.

4. An image forming apparatus comprising:

an image support medium;

a charging member for charging the surface of said image support medium in contact with the surface thereof;

an exposure means for irradiating with light the surface of the image support medium charged by said charging member to form a static latent image;

a developing means for supplying developer to the static latent image formed on said image support medium to develop the latent image and for removing the leftover developer on the image support medium;

a transfer means for transferring the developer image, which has been developed on the image support medium by said developing means, to a member to be transferred; and a scraping member for scraping foreign matter on said image support medium, wherein said charging member causes the developer to adhere to the foreign matter scraped by said scraping member and place the foreign matter onto said image support medium, and the foreign matter conveyed by said image support medium is collected from said image support medium by said developing means;

wherein said scraping member comprises an elastic member which abuts on said image support medium and a holding member for holding said elastic member; and wherein said holding member has an opening to allow the foreign matter to pass therethrough.

* * * * *